US011047384B2

(12) United States Patent
Nakai et al.

(10) Patent No.: US 11,047,384 B2
(45) Date of Patent: Jun. 29, 2021

(54) SCROLL COMPRESSOR WITH NON-UNIFORM GAP

(71) Applicant: DAIKIN INDUSTRIES, LTD., Osaka (JP)

(72) Inventors: Ryouta Nakai, Osaka (JP); Yasuhiro Murakami, Osaka (JP); Yasuo Mizushima, Osaka (JP); Masahiro Noro, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 257 days.

(21) Appl. No.: 16/313,642

(22) PCT Filed: Jun. 30, 2017

(86) PCT No.: PCT/JP2017/024162

§ 371 (c)(1),
(2) Date: Dec. 27, 2018

(87) PCT Pub. No.: WO2018/008550

PCT Pub. Date: Jan. 11, 2018

(65) Prior Publication Data

US 2020/0182244 A1 Jun. 11, 2020

(30) Foreign Application Priority Data

Jul. 6, 2016 (JP) ..... JP2016-133795

(51) Int. Cl.
*F04C 18/02* (2006.01)
*F01C 1/02* (2006.01)
*F04C 23/00* (2006.01)

(52) U.S. Cl.
CPC ..... *F04C 18/0215* (2013.01); *F04C 23/008* (2013.01); *F04C 18/0253* (2013.01);
(Continued)

(58) Field of Classification Search
CPC ..... F04C 18/0276; F04C 18/0269; F04C 18/0253; F04C 18/0246; F04C 18/0215;
(Continued)

(56) References Cited

U.S. PATENT DOCUMENTS 4,548,555 A * 10/1985 Hiraga ..... F01C 1/0246 418/55.2
5,496,161 A * 3/1996 Machida ..... F04C 18/0276 418/55.2

(Continued)

FOREIGN PATENT DOCUMENTS

JP 7-19187 A 1/1995
JP 2007-239747 A 9/2007

(Continued)

OTHER PUBLICATIONS

International Preliminary Report of corresponding PCT Application No. PCT/JP2017/024162 dated Jan. 17, 2019.

(Continued)

*Primary Examiner* — Deming Wan
(74) *Attorney, Agent, or Firm* — Global IP Counselors, LLP

(57) ABSTRACT

A scroll compressor includes fixed and orbiting scrolls, and satisfies at least one of a first condition and a second condition. In the first condition, a first gap between a distal end of the first wrap and the second base changes heading from an outer peripheral side of the first wrap to an inner peripheral side. In the second condition, a second gap between a distal end of the second wrap and the first base changes heading from an outer peripheral side of the second wrap to an inner peripheral side. A rate of change in the first gap in one area is greater than a rate of change in the first gap
(Continued)

in another area. A rate of change in the second gap in one area is greater than a rate of change in the second gap in another area.

4 Claims, 5 Drawing Sheets

(52) U.S. Cl.
CPC .... *F04C 18/0269* (2013.01); *F04C 2210/268* (2013.01); *F04C 2230/602* (2013.01); *F04C 2240/30* (2013.01)

(58) Field of Classification Search
CPC .... F04C 23/008; F01C 1/0253; F01C 1/0246; F01C 1/0269; F01C 1/02; F01C 18/02
See application file for complete search history.

(56) References Cited

U.S. PATENT DOCUMENTS

| | | | | |
|---|---|---|---|---|
| 5,857,844 | A * | 1/1999 | Lifson | F04C 18/0276 418/1 |
| 2007/0178002 | A1 * | 8/2007 | Hiwata | F04C 18/0276 418/55.2 |
| 2007/0212246 | A1 | 9/2007 | Jeong et al. | |
| 2014/0123693 | A1 * | 5/2014 | Shimazu | F25B 49/02 62/115 |
| 2016/0003247 | A1 | 1/2016 | Matsumura et al. | |

FOREIGN PATENT DOCUMENTS

| | | | |
|---|---|---|---|
| JP | 2016-3645 | A | 1/2016 |
| WO | 2014/155646 | A1 | 10/2014 |

OTHER PUBLICATIONS

European Search Report of corresponding EP Application No. 17 82 4154.3 dated Dec. 12, 2019.
International Search Report of corresponding PCT Application No. PCT/JP2017/024162 dated Aug. 29, 2017.

* cited by examiner

SCROLL COMPRESSOR WITH NON-UNIFORM GAP

CROSS-REFERENCE TO RELATED APPLICATIONS

This U.S. National stage application claims priority under 35 U.S.C. § 119(a) to Japanese Patent Application No. 2016-133795, filed in Japan on Jul. 6, 2016, the entire contents of which are hereby incorporated herein by reference.

TECHNICAL FIELD

The present invention relates to a scroll compressor having a non-uniform gap.

BACKGROUND ART

A scroll compressor equipped with a fixed wrap and an orbiting wrap that have tooth bottom portions in which steps are formed so as to become deeper heading front an outer peripheral side to an inner peripheral side is known (see International Publication No. WO 2014/155646).

SUMMARY

The inventors of the present application discovered that in this type of scroll compressor the temperature inside the compression chamber during operation rises more exponentially than rises linearly heading from the outer peripheral side to the inner peripheral side. Consequently, for example, even if steps are formed in the tooth bottom portions so as to become deeper heading from the outer peripheral side to the inner peripheral side as in the scroll compressor of International Publication No. WO 2014/155646, the steps are insufficient, and, as a result, there is the concern that the fixed scroll and the orbiting scroll will contact each other. Particularly in a case where high compression efficiency is required in a low-load condition, the volumes of the fixed wrap and the orbiting wrap are designed smaller. In such a configuration as this, it is easy for the refrigerant to be over-compressed in a high-load condition, that is, it is easier for the temperature to rise, so the aforementioned problem becomes more pronounced.

It is a problem of the present invention to provide a scroll compressor that inhibits contact between the fixed scroll and the orbiting scroll.

A scroll compressor pertaining to a first aspect of the invention has a fixed scroll and an orbiting scroll. The fixed scroll has a first base and a first wrap. The first wrap is formed spirally on the first base. The orbiting scroll forms a compression chamber together with the fixed scroll. The orbiting scroll has a second base and a second wrap. The second wrap is formed spirally on the second base. The scroll compressor satisfies at least one of a first condition and a second condition. The first condition is a condition where a first gap between a distal end of the first wrap and the second base changes heading from an outer peripheral side of the first wrap to an inner peripheral side and where the rate of change in the first gap from a center of the first wrap to an intermediate point of the first wrap is greater than the rate of change in the first gap from the intermediate point of the first wrap to an outer peripheral end of the first wrap. The second condition is a condition where a second gap between a distal end of the second wrap and the first base changes heading from an outer peripheral side of the second wrap to an inner peripheral side and where the rate of change in the second gap from a center of the second wrap to an intermediate point of the second wrap is greater than the rate of change in the second gap from the intermediate point of the second wrap to an outer peripheral end of the second wrap.

In the scroll compressor pertaining to the first aspect of the invention, in a case where the rate of change in the first gap from the center of the first wrap to the intermediate point of the first wrap is greater than the rate of change in the first gap from the intermediate point of the first wrap to the outer peripheral end of the first wrap, the first gap from the center of the first wrap to the intermediate point of the first wrap becomes locally larger. Consequently, contact between the distal end of the first wrap and the second base can be inhibited at the portion of the first wrap from the center of the first wrap to the intermediate point of the first wrap.

In the same way, # in a case where the rate of change in the second gap from the center of the second wrap to the intermediate point of the second wrap is greater than the rate of change in the second gap from the intermediate point of the second wrap to the outer peripheral end of the second wrap, the second gap from the center of the second wrap to the intermediate point of the second wrap becomes locally larger. Consequently, contact between the distal end of the second wrap and the first base can be inhibited at the portion of the second wrap from the center of the second wrap to the intermediate point of the second wrap.

As described above, by satisfying at least one of the first condition and the second condition, contact between the fixed scroll and the orbiting scroll can be inhibited.

In a scroll compressor pertaining to a second aspect of the invention, the portion of the first wrap from the center of the first wrap to the intermediate point of the first wrap is a center portion of the first wrap, and the portion of the second wrap from the center of the second wrap to the intermediate point of the second wrap is a center portion of the second wrap.

In the scroll compressor pertaining to the second aspect of the invention, the first gap at the center portion of the first wrap is set to become locally larger in anticipation of expansion of the first wrap due to heat at the center portion of the compression chamber, which can reach a particularly high temperature. Consequently, contact between the fixed scroll and the orbiting scroll at the center portion of the compression chamber can be inhibited.

In the same way, the second gap at the center portion of the second wrap is set to become locally larger in anticipation of expansion of the second wrap due to heat at the center portion of the compression chamber, which can reach a particularly high temperature. Consequently, contact between the fixed scroll and the orbiting scroll at the center portion of the compression chamber can be inhibited.

In a scroll compressor pertaining to a third aspect of the invention, the first gap changes in a stepwise manner heading from the outer peripheral side of the first wrap to the inner peripheral side. The second gap changes in a stepwise manner heading from the outer peripheral side of the second wrap to the inner peripheral side.

In the scroll compressor pertaining to the third aspect of the invention, the first gap and the second gap gradually change heading toward the center portion of the compression chamber, so contact between the fixed scroll and the orbiting scroll can be effectively inhibited.

In a scroll compressor pertaining to a fourth aspect of the invention, at least one of the first wrap and the second base is formed in a stepwise manner, whereby the first gap changes in a stepwise manner heading from the outer peripheral side of the first wrap to the inner peripheral side. At least one of the second wrap and the first base is formed in a stepwise manner, whereby the second gap changes in a stepwise manner heading from the outer peripheral side of the second wrap to the inner peripheral side. The at least one of the first wrap and the second base includes at least one step portion in the range of the center portion of the first wrap. The at least one of the second wrap and the first base includes at least one step portion in the range of the center portion of the second wrap.

In the scroll compressor pertaining to the fourth aspect of the invention, at least one of the first wrap and the second base is formed in a stepwise manner, so compared to a case where it is formed in a sloping manner, for example, processing for forming the first gap becomes easy. In the same way, at least one of the second wrap and the first base is formed in a stepwise manner, so compared to a case where it is formed in a sloping manner, for example, processing for forming the second gap becomes easy. Furthermore, because of the step portion included in the range of the center portion of the first wrap, the first gap can easily be made locally larger. In the same way, because of the step portion included in the range of the center portion of the second wrap, the second gap can easily be made locally larger.

In a scroll compressor pertaining to a fifth aspect of the invention, the center portion of the first wrap is a range from the center of the first wrap to 540°. The center portion of the second wrap is a range from the center of the second wrap to 540°.

In the scroll compressor pertaining to the fifth aspect of the invention, the first gap in the range from the center of the first wrap to 540° and the second gap in the range from the center of the second wrap to 540°, which can reach a particularly high temperature, become locally larger. Consequently, contact between the fixed scroll and the orbiting scroll can be effectively inhibited.

In a scroll compressor pertaining to a sixth aspect of the invention, the rate of change in the first gap from the center of the first wrap to the intermediate point of the first wrap is in the range of 4.5 times to 5.5 times the rate of change in the first gap from the intermediate point of the first wrap to the outer peripheral end of the first wrap. The rate of change in the second gap from the center of the second wrap to the intermediate point of the second wrap is in the range of 4.5 times to 5.5 times the rate of change in the second gap from the intermediate point of the second wrap to the outer peripheral end of the second wrap.

In the scroll compressor pertaining to the sixth aspect of the invention, the rate of change in the first gap from the center of the first wrap to the intermediate point of the first wrap is in the range of 4.5 times to 5.5 times the rate of change in the first gap from the intermediate point of the first wrap to the outer peripheral end of the first wrap, and the rate of change in the second gap from the center of the second wrap to the intermediate point of the second wrap is in the range of 4.5 times to 5.5 times the rate of change in the second gap from the intermediate point of the second wrap to the outer peripheral end of the second wrap, so contact between the fixed scroll and the orbiting scroll can be effectively inhibited.

In a scroll compressor pertaining to a seventh aspect of the invention, the fixed scroll and the orbiting scroll compress refrigerant that includes more than 50 wt % R32 as refrigerant.

When R410A refrigerant and refrigerant that includes more than 50 wt % R32 are compressed under the same conditions, the refrigerant that includes more than 50 wt % R32 reaches a higher temperature than the R410A refrigerant. That is, it becomes easier for the first wrap and the second wrap to deform. Even in a case such as this, the scroll compressor pertaining to the seventh aspect of the invention satisfies at least one of the first condition and the second condition, so contact between the fixed scroll and the orbiting scroll can be inhibited.

In the scroll compressor pertaining to the first aspect of the invention, by satisfying at least one of the first condition and the second condition, contact between the fixed scroll and the orbiting scroll can be inhibited.

In the scroll compressor pertaining to the second aspect of the invention, contact between the fixed scroll and the orbiting scroll at the center portion of the compression chamber can be inhibited.

In the scroll compressor pertaining to the third aspect of the invention, contact between the fixed scroll and the orbiting scroll can be effectively inhibited.

In the scroll compressor pertaining to the fourth aspect of the invention, processing for forming the first gap and the second gap becomes easy. Furthermore, the first gap at the center portion of the first wrap and the second gap at the center portion of the second wrap can easily be made locally larger.

In the scroll compressor pertaining to the fifth aspect of the invention, contact between the fixed scroll and the orbiting scroll at the portion that reaches a particularly high temperature can be effectively inhibited.

In the scroll compressor pertaining to the sixth aspect of the invention, contact between the fixed scroll and the orbiting scroll can be effectively inhibited.

In the scroll compressor pertaining to the seventh aspect of the invention, refrigerant that includes more than 50 wt % R32 is compressed, so even in a case where it becomes easier for the first wrap and the second wrap to deform, contact between the fixed scroll and the orbiting scroll can be inhibited.

DETAILED DESCRIPTION OF EMBODIMENT(S)

An embodiment of the invention will be described below. It will be noted that the following embodiment is merely a concrete example and is not intended to limit the invention pertaining to the scope of the claims.

Figure 1:
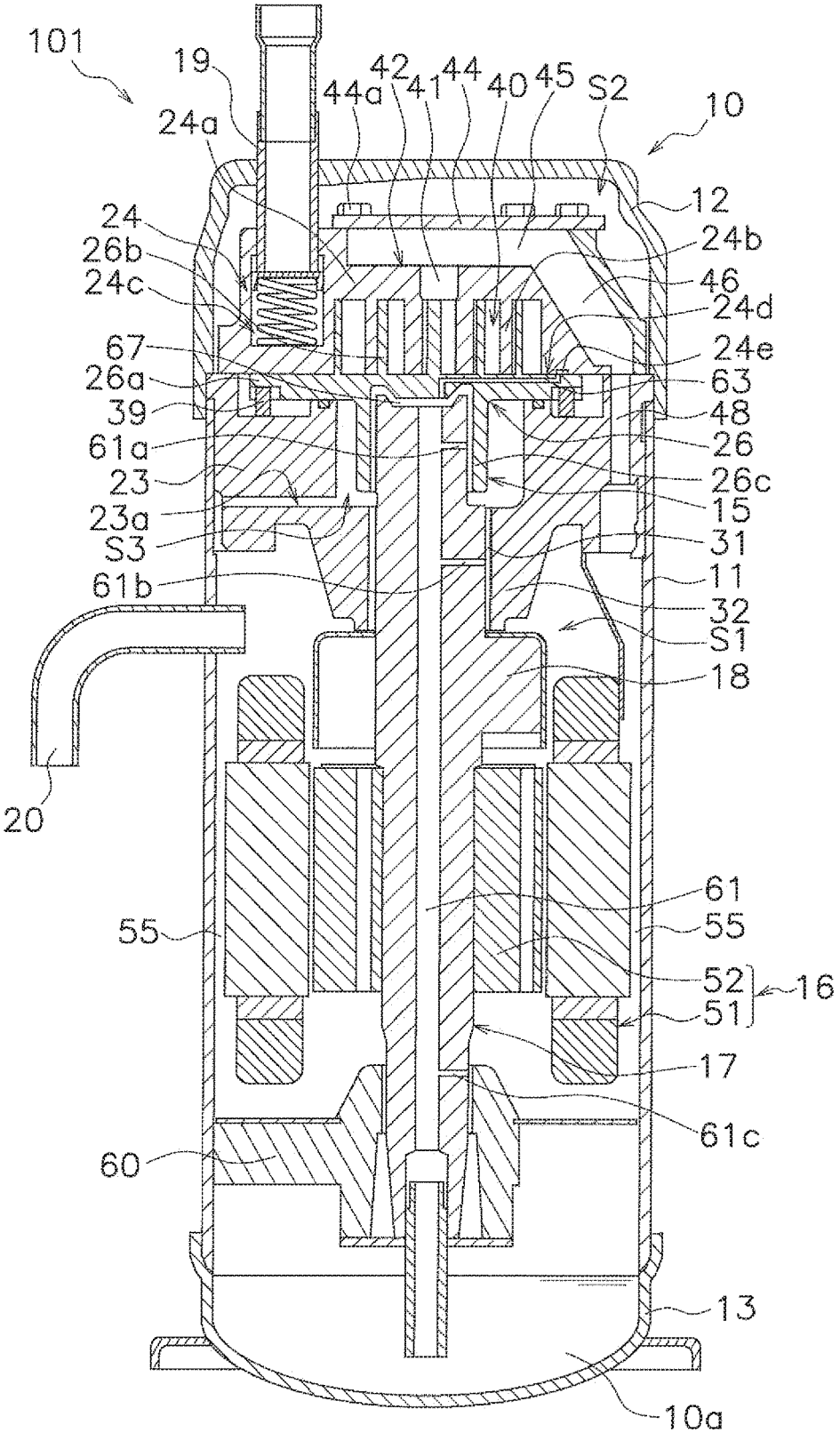
FIG. 1 is a longitudinal sectional view of a scroll compressor pertaining to an embodiment.

FIG. 1 is a longitudinal sectional view of a scroll compressor 101 pertaining to the embodiment. The scroll compressor 101 is used in a refrigerating system such as an air conditioning system. The scroll compressor 101 compresses refrigerant gas that circulates through a refrigerant circuit of the refrigerating system. As the refrigerant, refrigerant that includes more than 50 wt % R32 can be used.

(1) Configuration of Scroll Compressor

The scroll compressor 101 mainly has a casing 10, a compression mechanism 15, a housing 23, an Oldham coupling 39, a drive motor 16, a lower bearing 60, a crankshaft 17, a suction pipe 19, and a discharge pipe 20.

(1-1) Casing

The casing 10 is configured from a middle casing portion 11 in the shape of an open cylinder, an upper wall portion 12 in the shape of a bowl, and a bottom wall portion 13 in the shape of a bowl. The upper wall portion 12 is airtightly welded to the upper end portion of the middle casing portion 11. The bottom wall portion 13 is airtightly welded to the lower end portion of the middle casing portion 11. The casing 10 is installed in such a way that the axial direction of the open cylinder shape of the middle casing portion 11 lies along the vertical direction.

Inside the casing 10 are housed the compression mechanism 15, the housing 23, the drive motor 16, the crankshaft 17, and the like. In the bottom portion of the casing 10 is formed an oil reservoir 10*a* in which lubricating oil is stored. The lubricating oil is used to well maintain the lubricity of sliding portions of the compression mechanism 15 and the like during the operation of the scroll compressor 101.

(1-2) Compression Mechanism

The compression mechanism 15 sucks and compresses low-temperature low-pressure refrigerant gas and discharges compressed refrigerant that is high-temperature high-pressure refrigerant gas. The compression mechanism 15 is configured mainly from a fixed scroll 24 and an orbiting scroll 26. The fixed scroll 24 is fixed with respect to the casing 10. The orbiting scroll 26 performs revolving movement with respect to the fixed scroll 24.

(1-2-1) Fixed Scroll

The fixed scroll 24 has a first end plate 24*a* serving as a first base and a first wrap 24*b*. The first wrap 24*b* is formed upright on the first end plate 24*a*. The first wrap 24*b* is spiral in shape. The height of the first wrap 24*b* is preferably 20 to 40 mm. The number of turns of the first wrap 24*b* is longer than the number of turns of a later-described second wrap 26*b*. Specifically, it is about ½ turn longer. An outer peripheral surface is not formed on the outermost periphery of the first wrap 24*b*. The outermost periphery of the first wrap 24*b* is continuous with the edge portion of the fixed scroll 24. A main suction hole 24*c* is formed in the first end plate 24*a*. The main suction hole 24*c* is a space that interconnects the suction pipe 19 and a later-described compression chamber 40. The main suction hole 24*c* forms a suction space. The suction space is a space for introducing the low-temperature low-pressure refrigerant gas from the suction pipe 19 to the compression chamber 40.

A discharge hole 41 is formed in the central portion of the first end plate 24*a*. An enlarged recess portion 42 that communicates with the discharge hole 41 is formed in the upper surface of the first end plate 24*a*. The enlarged recess portion 42 is a space that is recessedly provided in the upper surface of the first end plate 24*a*. A cover 44 is fixed by bolts 44*a* to the upper surface of the fixed scroll 24 so as to close off the enlarged recessed portion 42. The fixed scroll 24 and the cover 44 are tightly sealed via a gasket (not shown in the drawings). A muffler space 45 that muffles the operating sound of the compression mechanism 15 is formed as a result of the enlarged recessed portion 42 being covered with the cover 44. A first compressed refrigerant flow passage 46 that communicates with the muffler space 45 and opens to the lower surface of the fixed scroll 24 is formed in the fixed scroll 24. An oil groove 24*e* is formed in the lower surface of the first end plate 24*a*.

(1-2-2) Orbiting Scroll

The orbiting scroll 26 has a second end plate 26*a* serving as a second base and a second wrap 26*b*. The second end plate 26*a* is in the shape of a disc. An upper end bearing 26*c* is formed in the central portion of the lower surface of the second end plate 26*a*. The second wrap 26*b* is formed upright on the second end plate 26*a*. The second wrap 26*b* is spiral in shape. The height of the second wrap 26*b* is preferably 20 to 40 mm. An oil supply pore 63 is formed in the orbiting scroll 26. The oil supply pore 63 communicates the outer peripheral portion of the upper surface of the second end plate 26*a* to the space inside the upper end bearing 26*c*.

The first wrap 24*b* and the second wrap 26*b* interfit, whereby the fixed scroll 24 and the orbiting scroll 26 form a compression chamber 40. The compression chamber 40 is a space enclosed by the first end plate 24*a*, the first wrap 24*b*, the second end plate 26*a*, and the second wrap 26*b*. The volume of the compression chamber 40 gradually decreases because of the revolving movement of the orbiting scroll 26. As the orbiting scroll 26 revolves, the lower surface of the first end plate 24*a* and the first wrap 24*b* of the fixed scroll 24 slides against the upper surface of the second end plate 26*a* and the second wrap 26*b* of the orbiting scroll 26. In this specification, the surface of the fixed scroll 24 that slides against the orbiting scroll 26 is called a sliding surface 24*d*.

Although details will be described later, a first gap is formed between the distal end of the first wrap 24*b* (i.e., the portion of the first wrap 24*b* that opposes the second end plate 26*a*) and the second end plate 26*a*. A second gap is formed between the distal end of the second wrap 26*b* (i.e., the portion of the second wrap 26*b* that opposes the first end plate 24*a*) and the first end plate 24*a*. In the present embodiment, both a first condition and a second condition described below are satisfied in relation to the first gap and the second gap.

The first condition is a condition where the first gap changes heading from the outer peripheral side of the first wrap 24*b* to the inner peripheral side and where the rate of change in the first gap in a range from a center 24*p* (see FIG. 2) of the first wrap 24*b* to an intermediate point of the first wrap 24*b* is greater than the rate of change in the first gap in a range from the intermediate point of the first wrap 24*b* to the outer peripheral end of the first wrap 24*b*. In the present embodiment, the range from the center 24*p* of the first wrap 24*b* to the intermediate point of the first wrap 24*b* is a range from the center 24*p* of the first wrap 24*b* to 540°. The range from the intermediate point of the first wrap 24*b* to the outer peripheral end of the first wrap 24*b* is a range from 540° of the first wrap 24*b* to 1080°.

Although details will be described later, the rate of change in the first gap in the range from the center 24*p* of the first wrap 24*b* to 540° is a value obtained by dividing the amount of change in the height of the first gap in the range from the center 24*p* of the first wrap 24*b* to 540° by the number of steps included in the portion of the second end plate 26*a* corresponding to the range from the center 24*p* of the first wrap 24*b* to 540°. The rate of change in the first gap in the range from 540° of the first wrap 24*b* to 1080° is a value obtained by dividing the amount of change in the height of the first gap in the range from 540° of the first wrap 24*b* to 1080° by the number of steps included in the portion of the second end plate 26*a* corresponding to the range from 540° of the first wrap 24*b* # to 1080°.

The second condition is a condition where the second gap changes heading from the outer peripheral side of the second wrap 26*b* to the inner peripheral side and where the rate of change in the second gap in a range from a center 26*p* (see FIG. 3) of the second wrap 26*b* to an intermediate point of the second wrap 26*b* is greater than the rate of change in the second gap in a range from the intermediate point of the second wrap 26*b* to the outer peripheral end of the second wrap 26*b*. In the present embodiment, the range from the center 26*p* of the second wrap 26*b* to the intermediate point of the second wrap 26*b* is a range from the center 26*p* of the second wrap 24*b* to 540°. The range from the intermediate point of the second wrap 26*b* to the outer peripheral end of the second wrap 26*b* is a range from 540° to 900° of the second wrap 26*b*.

Although details will be described later, the rate of change in the second gap in the range from the center 26*p* of the second wrap 26*b* to 540° is a value obtained by dividing the amount of change in the height of the second gap in the range from the center 26*p* of the second wrap 26*b* to 540° by the number of steps included in the portion of the first end plate 24*a* corresponding to the range from the center 26*p* of the second wrap 26*b* to 540°. The rate of change in the second gap in the range from 540° of the second wrap 26*b* to 900° is a value obtained by dividing the amount of change in the height of the second gap in the range from 540° of the second wrap 26*b* to 900° by the number of steps included in the portion of the first end plate 24*a* corresponding to the range from 540° of the second wrap 26*b* # to 900°.

(1-3) Housing

The housing 23 is disposed under the compression mechanism 15. The outer peripheral surface of the housing 23 is airtightly joined to the inner peripheral surface of the middle casing portion 11. Because of this, the inside space of the casing 10 is partitioned into a high-pressure space S1 under the housing 23 and a low-pressure space S2 that is a space above the housing 23. The housing 23 has the fixed scroll 24 mounted on it and, together with the fixed scroll 24, sandwiches the orbiting scroll 26. A second compressed refrigerant flow passage 48 is formed in, so as to run in the vertical direction through, the outer peripheral portion of the housing 23. The second compressed refrigerant flow passage 48 communicates with the first compressed refrigerant flow passage 46 at the upper surface of the housing 23 and communicates with the high-pressure space S1 at the lower surface of the housing 23.

A crank chamber S3 is recessedly provided in the upper surface of the housing 23. A housing through hole 31 is formed in the housing 23. The housing through hole 31 runs in the vertical direction through the housing 23 from the central portion of the bottom surface of the crank chamber S3 to the central portion of the lower surface of the housing 23. In this specification, the part of the housing 23 that has the housing through hole 31 formed in it is called an upper bearing 32. In the housing 23 is formed an oil return passageway 23*a* that communicates the high-pressure space S1 in the neighborhood of the inner surface of the casing 10 to the crank chamber S3.

(1-4) Oldham Coupling

The Oldham coupling 39 is an annular member installed between the orbiting scroll 26 and the housing 23. The Oldham coupling 39 is a member for preventing self-rotation of the revolving orbiting scroll 26.

(1-5) Drive Motor

The drive motor 16 is a brushless DC motor disposed under the housing 23. The drive motor 16 is configured mainly from a stator 51 fixed to the inner surface of the casing 10 and a rotor 52 disposed inside the stator 51 with an air gap between them.

In the outer peripheral surface of the stator 51 are provided plural core cut portions comprising cutouts formed a predetermined interval apart from each other in the circumferential direction and ranging from the upper end surface of the stator 51 to the lower end surface. The core cut portions form motor cooling passageways 55 that extend in the vertical direction between the middle casing portion 11 and the stator 51.

The rotor 52 is coupled to the crankshaft 17, which runs in the vertical direction through the rotational center of the rotor 52. The rotor 52 is connected via the crankshaft 17 to the compression mechanism 15.

(1-6) Lower Bearing

The lower bearing 60 is disposed under the drive motor 16. The outer peripheral surface of the lower bearing 60 is airtightly joined to the inner surface of the casing 10. The lower bearing 60 supports the crankshaft 17.

(1-7) Crankshaft

The crankshaft 17 is disposed in such a way that its axial direction lies along the vertical direction. The crankshaft 17 has a shape in which the axial center of the upper end portion of the crankshaft 17 is slightly eccentric with respect to the axial center of the portion excluding the upper end portion. The crankshaft 17 has a counterweight 18. The counterweight 18 is tightly fixed to the crankshaft 17 at a height position under the housing 23 and above the drive motor 16.

The crankshaft 17 runs in the vertical direction through the rotational center of the rotor 52 and is coupled to the rotor 52. The upper end portion of the crankshaft 17 is fitted into the upper end bearing 26*c*, whereby the crankshaft 17 is connected to the orbiting scroll 26. The crankshaft 17 is supported by the upper bearing 32 and the lower bearing 60.

The crankshaft 17 has inside a main oil supply passage 61 that extends in the axial direction of the crankshaft 17. The upper end of the main oil supply passage 61 communicates with an oil chamber 67 formed by the upper end surface of the crankshaft 17 and the lower surface of the second end plate 26*a*. The oil chamber 67 communicates with the sliding surface 24*d* and the oil groove 24*e* via the oil supply pore 63 in the second end plate 26*a* and finally communicates with the low-pressure space S2 via the compression chamber 40. The lower end of the main oil supply passage 61 is connected to an oil supply pipe that is a pipe for supplying to the compression mechanism 15 the lubricating oil stored in the oil reservoir 10*a*.

The crankshaft 17 has a first auxiliary oil supply passage 61*a*, a second auxiliary oil supply passage 61*b*, and a third auxiliary oil supply passage 61*c* that branch from the main oil supply passage 61. The first auxiliary oil supply passage 61*a*, the second auxiliary oil supply passage 61*b*, and the third auxiliary oil supply passage 61*c* extend in the horizontal direction. The first auxiliary oil supply passage 61*a* opens to the sliding surfaces of the crankshaft 17 and the upper end bearing 26*c* of the orbiting scroll 26. The second auxiliary oil supply passage 61*b* opens to the sliding surfaces of the crankshaft 17 and the upper bearing 32 of the housing 23. The third auxiliary oil supply passage 61*c* opens to the sliding surfaces of the crankshaft 17 and the lower bearing 60.

(1-8) Suction Pipe

The suction pipe 19 is a pipe for introducing the refrigerant in the refrigerant circuit from the outside of the casing 10 to the compression mechanism 15. The suction pipe 19 is airtightly fitted into the upper wall portion 12 of the casing 10. The suction pipe 19 runs in the vertical direction through the low-pressure space S2.

(1-9) Discharge Pipe

The discharge pipe 20 is a pipe for discharging the compressed refrigerant from the high-pressure space S1 to the outside of the casing 10. The discharge pipe 20 is airtightly fitted into the middle casing portion 11 of the casing 10. The discharge pipe 20 runs in the horizontal direction through the high-pressure space S1.

(2) Details of Fixed Scroll and Orbiting Scroll

Figure 2:
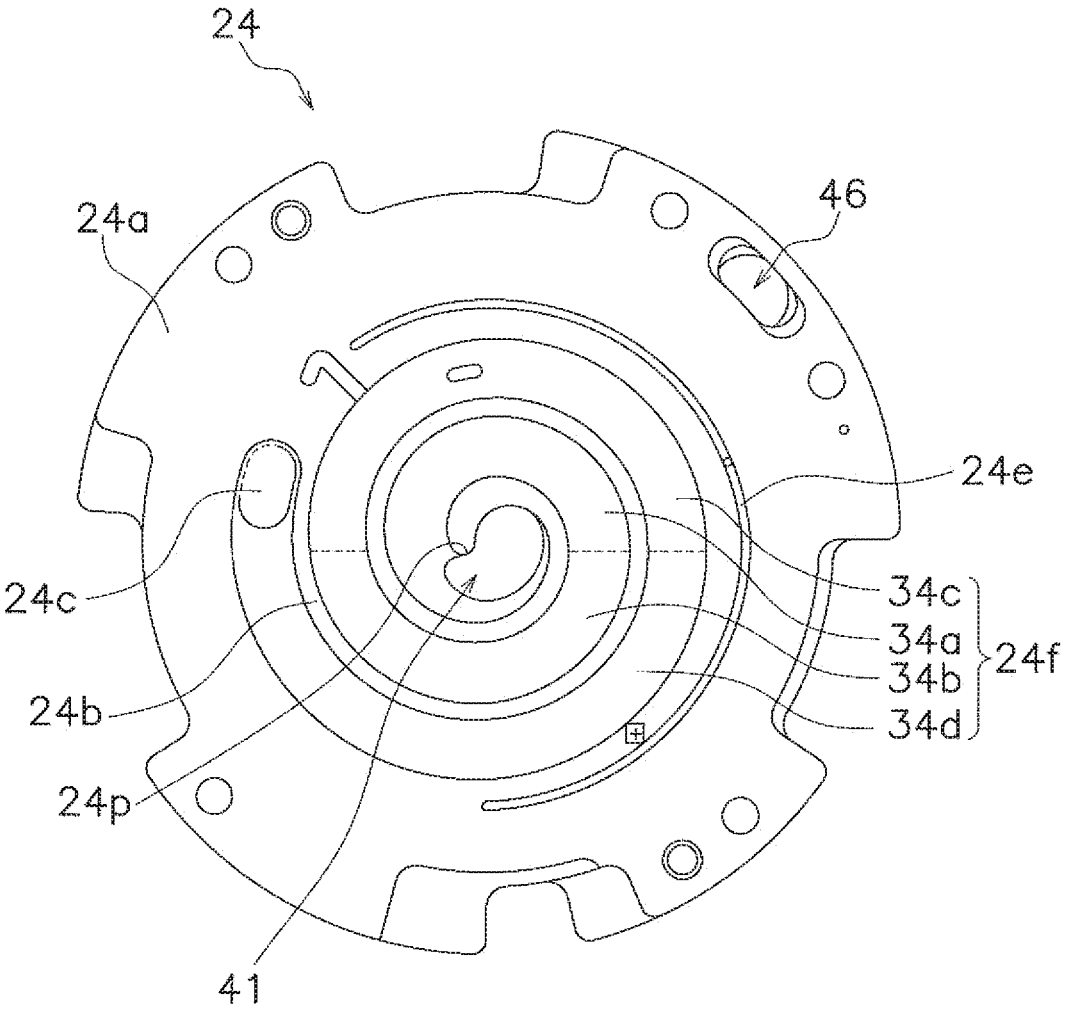
FIG. 2 is a bottom view of a fixed scroll.

FIG. 2 is a bottom view of the fixed scroll 24 seen along the vertical direction. Plural regions are formed in a refrigerant flow passage portion 24*f* of the fixed scroll 24 from the main suction hole 24*c* to the discharge hole 41. In the present embodiment, four regions are formed. Namely, a first region 34*a*, a second region 34*b*, a third region 34*c*, and a fourth region 34*d* are formed.

The first region 34*a* is a region on the innermost peripheral side of the refrigerant flow passage portion 24*f*. In the present embodiment, the first region 34*a* is a region corresponding to a range from the center 24*p* of the first wrap 24*b* (i.e., the start of the spiral) to 540°. In the present embodiment, the range from the center 24*p* of the first wrap 24*b* to 540° is defined as the center portion of the first wrap 24*b*, and the first region 34*a* is defined as the center portion of the first end plate 24*a*. The center portions of the first wrap 24*b* and the first end plate 24*a* form a center portion of the compression chamber 40.

The second region 34*b* is a region continuous with the first region 34*a*. The second region 34*b* is a region between the first region 34*a* and the third region 34*c*. In the present embodiment, the second region 34*b* is a region corresponding to a range from 540° of the first wrap 24*b* to 720°.

The third region 34*c* is a region continuous with the second region 34*b*. The third region 34*c* is a region between the second region 34*b* and the fourth region 34*d*. In the present embodiment, the third region 34*c* is a region corresponding to a range from 720° of the first wrap 24*b* to 900°.

The fourth region 34*d* is a region continuous with the third region 34*c*. The fourth region 34*d* is a region on the outermost peripheral side of the refrigerant flow passage portion 24*f*. In the present embodiment, the fourth region 34*d* is a region corresponding to a range from 900° of the first wrap 24*b* to the outer peripheral end (1080°).

In the present embodiment, the range from 540° of the first wrap 24*b* to the outer peripheral end is defined as the non-center portion of the first wrap 24*b*, and the second region 34*b*, the third region 34*c*, and the fourth region 34*d* are defined as the non-center portion of the first end plate 24*a*. The non-center portions of the first wrap 24*b* and the first end plate 24*a* form a non-center portion of the compression chamber 40.

Figure 3:
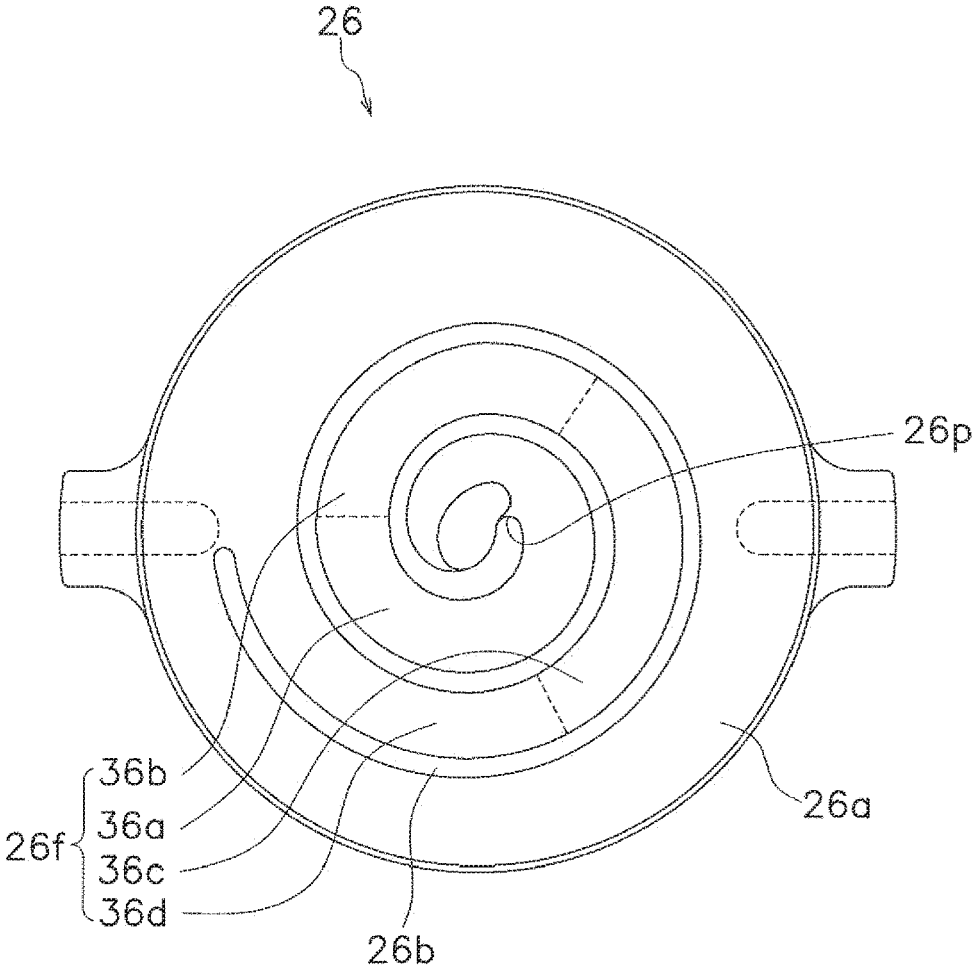
FIG. 3 is a top view of an orbiting scroll.

FIG. 3 is a top view of the orbiting scroll 26 seen along the vertical direction. Plural regions are formed in a refrigerant flow passage portion 26*f* of the orbiting scroll 26 surrounded from the center 26*p* of the second wrap 26*b* to the outer peripheral end. In the present embodiment, four regions are formed. Namely, a first region 36*a*, a second region 36*b*, a third region 36*c*, and a fourth region 36*d* are formed.

The first region 36*a* is a region on the innermost peripheral side of the refrigerant flow passage portion 26*f*. In the present embodiment, the first region 36*a* is a region corresponding to a range from the center 26*p* of the second wrap 26*b* (i.e., the start of the spiral) to 540°. In the present embodiment, the range from the center 26*p* of the second wrap 26*b* to 540° is defined as the center portion of the second wrap 26*b*, and the first region 36*a* is defined as the center portion of the second end plate 26*a*. The center portions of the second wrap 26*b* and the second end plate 26*a* form the center portion of the compression chamber 40.

The second region 36*b* is a region continuous with the first region 36*a*. The second region 36*b* is a region between the first region 36*a* and the third region 36*c*. In the present embodiment, the second region 36*b* is a region corresponding to a range from 540° of the second wrap 26*b* to 660°.

The third region 36*c* is a region continuous with the second region 36*b*. The third region 36*c* is a region between the second region 36*b* and the fourth region 36*d*. In the present embodiment, the third region 36*c* is a region corresponding to a range from 660° of the second wrap 26*b* to 780°.

The fourth region 36*d* is a region continuous with the third region 36*c*. The fourth region 36*d* is a region on the outermost peripheral side of the refrigerant flow passage portion 26*f*. In the present embodiment, the fourth region 36*d* is a region corresponding to a range from 780° of the second wrap 26*b* to the outer peripheral end (900°).

In the present embodiment, the range from 540° of the second wrap 26*b* to the outer peripheral end is defined as the non-center portion of the second wrap 26*b*, and the second region 36*b*, the third region 36*c*, and the fourth region 36*d* are defined as the non-center portion of the second end plate 26*a*. The non-center portions of the second wrap 26*b* and the second end plate 26*a* form the non-center portion of the compression chamber 40.

Figure 4A:
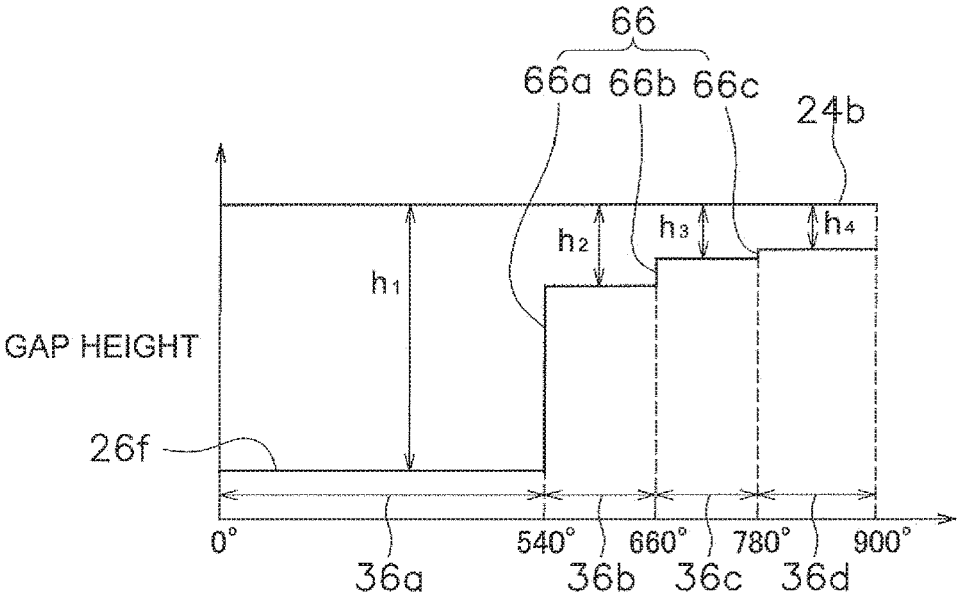
FIG. 4A is a drawing describing a first gap that is a gap between a first wrap and a second end plate.

FIG. 4A is a drawing describing the first gap that is a gap between the first wrap 24*b* and the second end plate 26*a*. In FIG. 4A, the horizontal axis represents the angle from the center 26*p* of the second wrap 26*b*. The vertical axis represents the height of the first gap. Namely, the vertical axis represents the distance between the distal end of the first wrap 24*b* and the second end plate 26*a* (particularly the refrigerant flow passage portion 26*f*). Gap height $h_1$ represents the distance between the distal end of the first wrap 24*b* and the first region 36*a*. Gap height $h_2$ represents the distance between the distal end of the first wrap 24*b* and the second region 36*b*. Gap height $h_3$ represents the distance between the distal end of the first wrap 24*b* and the third region 36*c*. Gap height $h_4$ represents the distance between the distal end of the first wrap 24*b* and the fourth region 36*d*.

As shown in FIG. 4A, the height of the refrigerant flow passage portion 26*f* changes heading from the outer peripheral side to the inner peripheral side. The height of the refrigerant flow passage portion 26*f* becomes lower heading from the outer peripheral side to the inner peripheral side. Namely, the thickness of the refrigerant flow passage portion 26*f* becomes thinner. In the present embodiment, the height of the refrigerant flow passage portion 26*f* becomes lower in a stepwise manner heading from the outer peripheral side toward the inner peripheral side. More specifically, the height of the refrigerant flow passage portion 26*f* becomes lower in the order of the fourth region 36*d*, the third region 36*c*, the second region 36*b*, and the first region 36*a*.

Three step portions 66 are formed in the refrigerant flow passage portion 26*f* as a result of the refrigerant flow passage portion 26*f* becoming lower in a stepwise manner. Namely, a step portion 66*a* is formed at the boundary between the second region 36*b* and the first region 36*a*, a step portion 66*b* is formed at the boundary between the third region 36*c* and the second region 36*b*, and a step portion 66*c* is formed at the boundary between the fourth region 36*d* and the third region 36*c*.

In contrast, the height of the first wrap 24*b* is constant. As a result, the height of the first gap changes heading from the outer peripheral side of the first wrap 24*b* to the inner peripheral side. The height of the first gap becomes wider heading from the outer peripheral side of the first wrap 24*b* to the inner peripheral side. The height of the first gap changes in a stepwise manner. Gap height $h_1$ is the largest, and gap height $h_4$ is the smallest.

As described above, the height of the refrigerant flow passage portion 26*f* changes, while the height of the first wrap 24*b* is constant. Consequently, the amount of change in the height of the refrigerant flow passage portion 26*f* can be understood as the amount of change in the first gap itself.

In the present embodiment, the center portion of the second end plate 26*a* includes the step portion 66*a*. Consequently, the gap heights at the outer peripheral end (i.e., the step portion 66*a*) and the inner peripheral end of the center portion of the second end plate 26*a* differ. Specifically, they differ by the difference between gap height $h_1$ and gap height $h_2$. The height of the step portion 66*a* is $h_1$-$h_2$.

In the present embodiment, the non-center portion of the second end plate 26*a* includes two step portions. Namely, the non-center portion of the second end plate 26*a* includes the step portion 66*b* and the step portion 66*c*. The height of the step portion 66*b* is $h_2$-$h_3$, and the height of the step portion 66*c* is $h_3$-$h_4$.

Figure 4B:
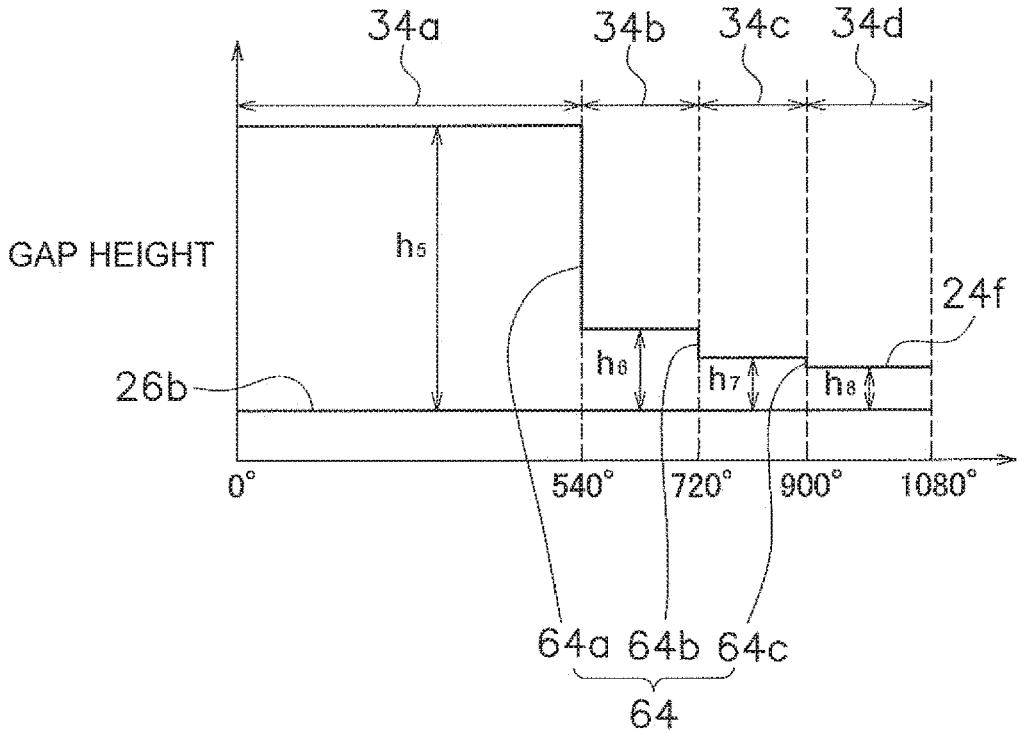
FIG. 4B is a drawing describing a second gap that is a gap between a first end plate and a second wrap.

FIG. 4B is a drawing describing the second gap that is a gap between the first end plate 24*a* and the second wrap 26*b*. In FIG. 4B, the horizontal axis represents the angle from the center 24*p* of the first wrap 24*b*. The vertical axis represents the height of the second gap. Namely, the vertical axis represents the distance between the first end plate 24*a* (particularly the refrigerant flow passage portion 24*f*) and the distal end of the second wrap 26*b*. Gap height $h_5$ represents the distance between the distal end of the second wrap 26*b* and the first region 34*a*. Gap height $h_6$ represents the distance between the distal end of the second wrap 26*b* and the second region 34*b*. Gap height $h_7$ represents the distance between the distal end of the second wrap 26*b* and the third region 34*c*. Gap height $h_8$ represents the distance between the distal end of the second wrap 26*b* and the fourth region 34*d*.

As shown in FIG. 4B, the height of the refrigerant flow passage portion 24*f* changes heading from the outer peripheral side to the inner peripheral side. The height of the refrigerant flow passage portion 24*f* becomes lower heading from the outer peripheral side toward the inner peripheral side. Namely, the thickness of the refrigerant flow passage portion 24*f* becomes thinner. In the present embodiment, the height of the refrigerant flow passage portion 24*f* becomes lower in a stepwise manner heading from the outer peripheral side toward the inner peripheral side. More specifically, the height of the refrigerant flow passage portion 24*f* becomes lower in the order of the fourth region 34*d*, the third region 34*c*, the second region 34*b*, and the first region 34*a*.

Three step portions 64 are formed in the refrigerant flow passage portion 24*f* as a result of the refrigerant flow passage portion 24*f* becoming lower in a stepwise manner. Namely, a step portion 64*a* is formed at the boundary between the second region 34*b* and the first region 34*a*, a step portion 64*b* is formed at the boundary between the third region 34*c* and the second region 34*b*, and a step portion 64*c* is formed at the boundary between the fourth region 34*d* and the third region 34*c*.

In contrast, the height of the second wrap 26*b* is constant. As a result, the height of the second gap changes heading from the outer peripheral side to the inner peripheral side of the second wrap 26*b*. The height of the second gap becomes wider heading from the outer peripheral side to the inner peripheral side of the second wrap 26*b*. The height of the second gap changes in a stepwise manner. Gap height $h_5$ is the largest, and gap height $h_8$ is the smallest.

As described above, the height of the refrigerant flow passage portion 24*f* changes, while the height of the second wrap 26*b* is constant. Consequently, the amount of change in the height of the refrigerant flow passage portion 24*f* can be understood as the amount of change in the second gap itself.

In the present embodiment, the center portion of the first end plate 24*a* includes the step portion 64*a*. Consequently, the gap heights at the outer peripheral end (i.e., the step portion 64*a*) and the inner peripheral end of the center portion of the first end plate 24*a* differ. Specifically, they differ by the difference between gap height $h_5$ and gap height $h_6$. The height of the step portion 64*a* is $h_5$-$h_6$.

In the present embodiment, the non-center portion of the first end plate 24*a* includes two step portions. Namely, the non-center portion of the first end plate 24*a* includes the step portion 64*b* and the step portion 64*c*. The height of the step portion 64*b* is $h_6$-$h_7$, and the height of the step portion 64*c* is $h_7$-$h_8$.

Figure 5A:
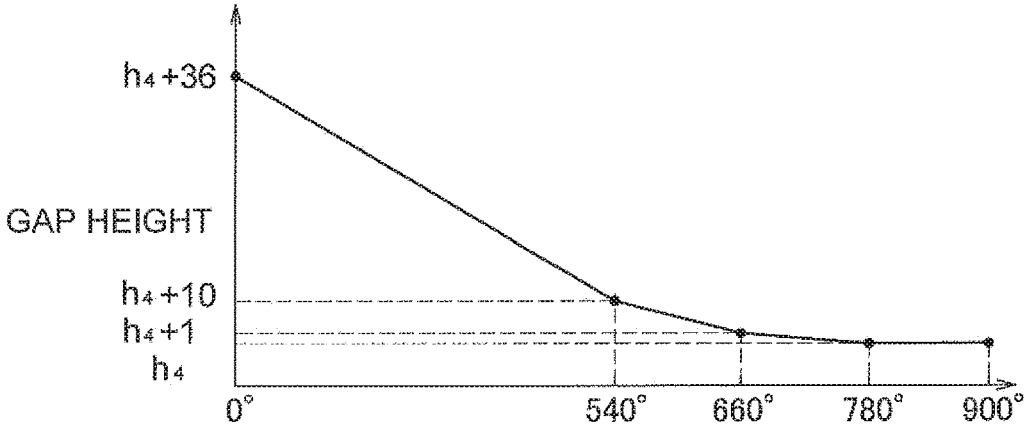
FIG. 5A is a drawing describing a change in the height of the first gap.

FIG. 5A is a drawing describing the change in the height of the first gap. In FIG. 5A, the horizontal axis represents the angle of the second wrap 26*b*, and the vertical axis represents the height of the first gap. Here, gap height $h_4$ is defined as a reference for the gap height. Furthermore, as an example, the height of the step portion 66*c* is defined as 1 μm, the height of the step portion 66*b* is defined as 9 μm, and the height of the step portion 66*a* is defined as 26 μm. In that case, gap height $h_3$ can be expressed as $h_4$+1, gap height $h_2$ can be expressed as $h_4$+10, and gap height $h_1$ can be expressed as $h_4$+36.

In the present embodiment, the amount of change at the center portion of the second end plate 26*a* is $h_1$-$h_2$=26 μm. The number of steps in the center portion of the second end plate 26*a* is 1, so the rate of change at the center portion of the second end plate 26*a* is 26. The amount of change at the non-center portion of the second end plate 26*a* is $h_2$-$h_4$=10 μm. The number of steps in the non-center portion of the second end plate 26*a* is 2, so the rate of change at the non-center portion of the second end plate 26*a* (the average of the amount of change per step) is 10/2=5.

As described above, the rate of change in the first gap at the center portion of the second end plate 26*a* is greater than the rate of change in the first gap at the non-center portion of the second end plate 26*a*. More specifically, the rate of change in the first gap at the center portion of the second end plate 26*a* is 5.2 times the rate of change in the first gap at the non-center portion of the second end plate 26*a*. The first gap becomes locally larger in the range of the center portion of the second end plate 26*a*. It will be noted that preferably the rate of change in the first gap at the center portion of the second end plate 26*a* is in the range of 4.5 times to 5.5 times the rate of change in the first gap at the non-center portion of the second end plate 26*a*.

Figure 5B:
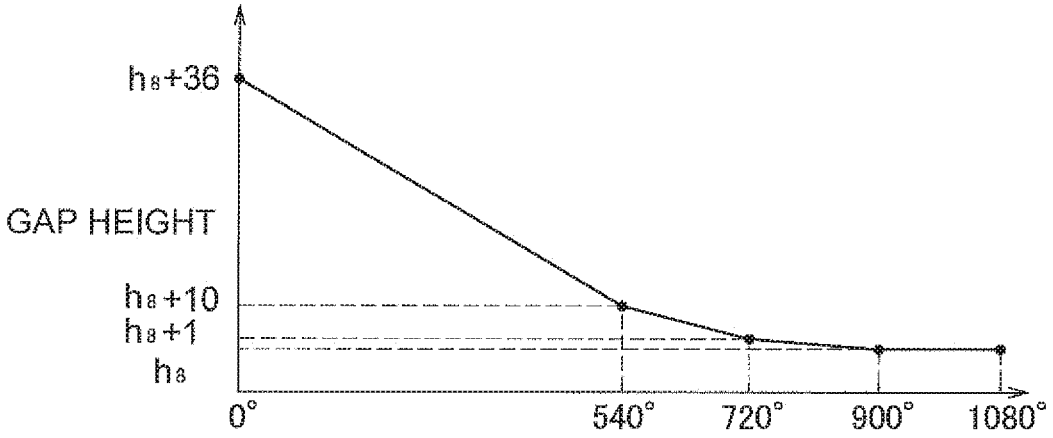
FIG. 5B is a drawing describing a change in the height of the second gap.

FIG. 5B is a drawing describing the change in the height of the second gap. In FIG. 5B, the horizontal axis represents the angle of the first wrap 24*b*, and the vertical axis represents the height of the second gap. Here, gap height $h_8$ is defined as a reference for the gap height. Furthermore, as an example, the height of the step portion 64*c* is defined as 1 μm, the height of the step portion 64*b* is defined as 9 μm, and the height of the step portion 64*a* is defined as 26 μm.

In that case, gap height $h_7$ can be expressed as $h_8$+1, gap height $h_6$ can be expressed as $h_8$+10, and gap height $h_5$ can be expressed as $h_8$+36.

In the present embodiment, the amount of change at the center portion of the first end plate 24*a* is $h_5$-$h_6$=26 μm. The number of steps in the center portion of the first end plate 24*a* is 1, so the rate of change at the center portion of the first end plate 24*a* is 26. The amount of change at the non-center portion of the first end plate 24*a* is $h_6$-$h_8$=10 μm. The number of steps in the non-center portion of the first end plate 24*a* is 2, so the rate of change at the non-center portion of the first end plate 24*a* (the average of the amount of change per step) is 10/2=5.

As described above, the rate of change in the second gap at the center portion of the first end plate 24*a* is greater than the rate of change in the second gap at the non-center portion of the first end plate 24*a*. More specifically, the rate of change in the second gap at the center portion of the first end plate 24*a* is 5.2 times the rate of change in the second gap at the non-center portion of the first end plate 24*a*. The second gap becomes locally larger in the range of the center portion of the first end plate 24*a*. It will be noted that preferably the rate of change in the second gap at the center portion of the first end plate 24*a* is in the range of 4.5 times to 5.5 times the rate of change in the second gap at the non-center portion of the first end plate 24*a*.

(3) Operation of Scroll Compressor

First, the rotor 52 is rotated by the driving of the drive motor 16. Because of this, the crankshaft 17 fixed to the rotor 52 rotates. The rotational movement of the crankshaft 17 is transmitted via the upper end bearing 26*c* to the orbiting scroll 26. The axial center of the upper end portion of the crankshaft 17 is eccentric with respect to the axis of the rotational movement of the crankshaft 17. The orbiting scroll 26 is engaged with the housing 23 via the Oldham coupling 39. Because of this, the orbiting scroll 26 performs revolving movement with respect to the fixed scroll 24 without self-rotating.

The low-temperature low-pressure refrigerant before being compressed is supplied from the suction pipe 19 via the main suction hole 24*c* to the compression chamber 40 of the compression mechanism 15. Because of the revolving movement of the orbiting scroll 26, the compression chamber 40 moves from the outer peripheral portion of the fixed scroll 24 to the center portion while its volume is gradually decreased. As a result, the refrigerant in the compression chamber 40 is compressed and becomes compressed refrigerant. When the compression chamber 40 moves from the outer peripheral portion of the fixed scroll 24 # to the center portion, the temperature of the compression chamber 40 rises in accompaniment with the move. Particularly in a case where the refrigerant is compressed in a high-load condition, the temperature rises more. In accompaniment with the rise in temperature, the fixed scroll 24 and the orbiting scroll 26 expand.

Here, in the scroll compressor 101 of the present embodiment, the first gap and the second gap are locally large at the center portion of the compression chamber 40, which is more susceptible to the effects of heat. Consequently, even if the fixed scroll 24 and the orbiting scroll 26 expand due to heat, contact between the fixed scroll 24 and the orbiting scroll 26 can be inhibited.

The compressed refrigerant is discharged from the discharge hole 41 to the muffler space 45 and thereafter is discharged via the first compressed refrigerant flow passage 46 and the second compressed refrigerant flow passage 48 to the high-pressure space S1. Then, the compressed refrigerant descends through the motor cooling passageways 55 and reaches the high-pressure space S1 under the drive motor 16. Then, the compressed refrigerant reverses its flow direction and ascends through other motor cooling passageways 55 and the air gap in the drive motor 16. Finally, the compressed refrigerant is discharged from the discharge pipe 20 to the outside of the scroll compressor 101.

(4) Characteristics of Scroll Compressor

In the scroll compressor 101 of the present embodiment, the rate of change in the first gap at the center portion of the second end plate 26*a* is greater than the rate of change in the first gap at the non-center portion of the second end plate 26*a*. The first gap in the range of the center portion of the second end plate 26*a* becomes locally larger. Consequently, in the center portion of the second end plate 26*a*, contact between the distal end of the first wrap 24*b* and the second end plate 26*a* can be inhibited. The first gap at the center portion of the first wrap 24*b* is set to become locally larger in anticipation of the expansion of the first wrap 24*b* due to heat at the center portion of the compression chamber 40, which can reach a particularly high temperature, so contact between the fixed scroll 24 and the orbiting scroll 26 at the center portion of the compression chamber 40 can be inhibited.

In the same way, the rate of change in the second gap at the center portion of the first end plate 24*a* is greater than the rate of change in the second gap at the non-center portion of the first end plate 24*a*. The second gap in the range of the center portion of the first end plate 24*a* becomes locally larger. Consequently, at the center portion of the first end plate 24*a*, contact between the distal end of the second wrap 26*b* and the first end plate 24*a* can be inhibited. The second gap at the center portion of the second wrap 26*b* is set to become locally larger in anticipation of the expansion of the second wrap 26*b* due to heat # at the center portion of the compression chamber 40, which can reach a particularly high temperature, so contact between the fixed scroll 24 and the orbiting scroll 26 at the center portion of the compression chamber 40 can be inhibited.

In the scroll compressor 101 of the present embodiment, the first gap changes in a stepwise manner heading from the outer peripheral side of the first wrap 24*b* # to the inner peripheral side. The second gap changes in a stepwise manner heading from the outer peripheral side of the second wrap 26*b* # to the inner peripheral side. The first gap and the second gap gradually change heading toward the center portion of the compression chamber 40, so contact between the fixed scroll 24 and the orbiting scroll 26 can be effectively inhibited.

In the scroll compressor 101 of the present embodiment, the second end plate 26*a* includes the step portion 66*a* in the range of the center portion of the first wrap 24*b*, and the first end plate 24*a* includes the step portion 64*a* in the range of the center portion of the second wrap 26*b*. Because of the step portion 66*a*, the first gap at the center portion of the second end plate 26*a* can easily be made locally larger. In the same way, because of the step portion 64*a*, the second gap at the center portion of the first end plate 24*a* can easily be made locally larger.

In the scroll compressor 101 of the present embodiment, the second end plate 26*a* is formed in a stepwise manner, whereby the first gap changes in a stepwise manner heading from the outer peripheral side of the first wrap 24*b* # to the inner peripheral side. The first end plate 24*a* is formed in a stepwise manner, whereby the second gap changes in a stepwise manner heading from the outer peripheral side of the second wrap 26*b* # to the inner peripheral side. Thus, compared to a case where the second end plate 26*a* and the first end plate 24*a* are formed in a sloping manner, processing for forming the first gap and the second gap becomes easy.

In the scroll compressor 101 of the present embodiment, the center portion of the first wrap 24*b* is a range from the center of the first wrap 24*b* to 540°. The center portion of the second wrap 26*b* is a range from the center of the second wrap 26*b* to 540°. The first gap in the range from the center of the first wrap 24*b* to 540° and the second gap in the range from the center of the second wrap 26*b* to 540°, which can reach a particularly high temperature, are made locally larger, so contact between the fixed scroll 24 and the orbiting scroll 26 can be effectively inhibited.

In the scroll compressor 101 of the present embodiment, the rate of change in the first gap at the center portion of the second end plate 26*a* is in the range of 4.5 times to 5.5 times the rate of change in the first gap at the non-center portion of the second end plate 26*a*. The rate of change in the second gap at the center portion of the first end plate 24*a* is in the range of 4.5 times to 5.5 times the rate of change in the second gap at the non-center portion of the first end plate 24*a*. Because of the above, contact between the fixed scroll 24 and the orbiting scroll 26 can be effectively inhibited.

In the scroll compressor 101 of the present embodiment, the fixed scroll 24 and the orbiting scroll 26 compress refrigerant that includes more than 50 wt % R32 as refrigerant. When R410A refrigerant and refrigerant that includes more than 50 wt % R32 are compressed under the same conditions, the refrigerant that includes more than 50 wt % R32 reaches a higher temperature than the R410A refrigerant. That is, it becomes easier for the first wrap 24*b* and the second wrap 26*b* to deform. Even in a case such as this, the scroll compressor 101 satisfies the first condition and the second condition, so contact between the fixed scroll 24 and the orbiting scroll 26 can be inhibited.

Example modifications applicable to the embodiment of the invention will be described.

(1) Example Modification A

In the above description, the second end plate 26*a* is formed in a stepwise manner, but the configuration whereby the first gap changes in a stepwise manner heading from the outer peripheral side of the first wrap 24*b* to the inner peripheral side is not limited to this. The first wrap 24*b* may also be formed in a stepwise manner, or the first wrap 24*b* and the second end plate 26*a* may also be formed in a stepwise manner. Namely, it suffices for at least one of the first wrap 24*b* and the second end plate 26*a* to be formed in a stepwise manner. It suffices for at least one of the first wrap 24*b* and the second end plate 26*a* to include a step portion in the range of the center portion of the first wrap 24*b*.

In the same way, in the above description, the first end plate 24*a* is formed in a stepwise manner, but the configuration whereby the second gap changes in a stepwise manner heading from the outer peripheral side of the second wrap 26*b* to the inner peripheral side is not limited to this. The second wrap 26*b* may also be formed in a stepwise manner, or the second wrap 26*b* and the first end plate 24*a* may also be formed in a stepwise manner. Namely, it suffices for at least one of the second wrap 26*b* and the first end plate 24*a* to be formed in a stepwise manner. It suffices for at least one of the second wrap 26*b* and the first end plate 24*a* to include a step portion in the range of the center portion of the second wrap 26*b*.

(2) Example Modification B

In the above description, three step portions are formed in each of the refrigerant flow passage portion 24*f* and the refrigerant flow passage portion 26*f*, but two step portions may also be formed, or four or more step portions may also be formed.

(3) Example Modification C

In the above description, the center portion of the first end plate 24*a* is a range from the center of the first wrap 24*b* to 540°, but the range of the center portion of the first end plate 24*a* is not limited to this. The range of the center portion of the first end plate 24*a* may also change in accordance with the number of step portions. For example, in a case where four step portions are formed in the refrigerant flow passage portion 24*f*, the center portion of the first end plate 24*a* may also be a range from the center of the first wrap 24*b* to 360°.

In the same way, the center portion of the second end plate 26*a* is a range from the center of the second wrap 26*b* to 540°, but the range of the center portion of the second end plate 26*a* is not limited to this. The range of the center portion of the second end plate 26*a* may also change in accordance with the number of step portions. For example, in a case where four step portions are formed in the refrigerant flow passage portion 26*f*, the center portion of the second end plate 26*a* may also be a range from the center of the second wrap 26*b* to 360°.

(4) Example Modification D

In the above description, the center portion of the first end plate 24*a* and the center portion of the second end plate 26*a* each have one step portion, but the configuration of the center portion of the first end plate 24*a* and the center portion of the second end plate 26*a* is not limited to this. The center portion of the first end plate 24*a* and the center portion of the second end plate 26*a* may also each have two or more step portions. Namely, it suffices for the center portion of the first end plate 24*a* and the center portion of the second end plate 26*a* to each include at least one step portion.

(5) Example Modification E

In the above description, the first gap and the second gap change in a stepwise manner, but the configuration of the first gap and the second gap is not limited to changing in a stepwise manner. The first gap and the second gap may also change in a sloping manner.

(6) Example Modification F

In the above description, the scroll compressor 101 satisfies both the first condition and the second condition, but the scroll compressor 101 may also satisfy just the first condition or may also satisfy just the second condition. Namely, it suffices for the scroll compressor 101 to satisfy at least one of the first condition and the second condition. More specifically, just the first gap at the center portion of the compression chamber 40 may become locally larger, or just the second gap at the center portion of the compression chamber 40 may become locally larger. Namely, it suffices for the gap at the center portion of the compression chamber 40 to become locally larger in at least one of the first gap and the second gap. By satisfying at least one of the first condition and the second condition, contact between the fixed scroll 24 and the orbiting scroll 26 can be inhibited.

(7) Example Modification G

In the above description, the change in the height of the first gap is the same as the change in the height of the second gap, but the change in the height of the first gap may also be different from the change in the height of the second gap.

The invention has been described above using an embodiment, but the technical scope of the invention is not limited to the scope described in the above embodiment. It will be apparent to persons skilled in the art that various changes or improvements can be made to the above embodiment. That embodiments to which such changes or improvements have been made can also be included in the technical scope of the invention will be apparent from the description of the scope of the claims.

What is claimed is:

1. A scroll compressor comprising:

a fixed scroll having a first base and a first wrap with a spiral shape formed on the first base; and an orbiting scroll that forms a compression chamber together with the fixed scroll, the orbiting scroll having a second base and a second wrap with a spiral shape formed on the second base, the scroll compressor satisfying at least one of a first condition in which a first gap between a distal end of the first wrap and the second base changes heading from an outer peripheral side of the first wrap to an inner peripheral side and a rate of change in the first gap from a center of the first wrap to an intermediate point of the first wrap is 4.5 to 5.5 times greater than a rate of change in the first gap from the intermediate point of the first wrap to an outer peripheral end of the first wrap, the intermediate point of the first wrap being disposed at 540° from the center of the first wrap, and a second condition in which a second gap between a distal end of the second wrap and the first base changes heading from an outer peripheral side of the second wrap to an inner peripheral side and a rate of change in the second gap from a center of the second wrap to an intermediate point of the second wrap is 4.5 to 5.5 times greater than a rate of change in the second gap from the intermediate point of the second wrap to an outer peripheral end of the second wrap, the intermediate point of the second wrap being disposed at 540° from the center of the second wrap.

2. The scroll compressor according to claim 1, wherein the first gap changes in a stepwise manner heading from the outer peripheral side of the first wrap to the inner peripheral side, and the second gap changes in a stepwise manner heading from the outer peripheral side of the second wrap to the inner peripheral side.

3. The scroll compressor according to claim 2, wherein at least one of the first wrap and the second base is formed in a stepwise manner, whereby the first gap changes in a stepwise manner heading from the outer peripheral side of the first wrap to the inner peripheral side, at least one of the second wrap and the first base is formed in a stepwise manner, whereby the second gap changes in a stepwise manner heading from the outer peripheral side of the second wrap to the inner peripheral side, the at least one of the first wrap and the second base includes at least one step portion in a range from the center of the first wrap to the intermediate point of the first wrap, and the at least one of the second wrap and the first base includes at least one step portion in a range from the center of the second wrap to the intermediate point of the second wrap.

4. The scroll compressor according to claim 1, wherein the fixed scroll and the orbiting scroll compress refrigerant that includes more than 50 wt % R32 as refrigerant.

* * * * *